United States Patent [19]

Venkat et al.

[11] Patent Number: 4,494,961

[45] Date of Patent: Jan. 22, 1985

[54] INCREASING THE CETANE NUMBER OF DIESEL FUEL BY PARTIAL OXIDATION

[75] Inventors: Chaya Venkat, Bellemead, N.J.; Dennis E. Walsh, Richboro, Pa.

[73] Assignee: Mobil Oil Corporation, New York, N.Y.

[21] Appl. No.: 504,115

[22] Filed: Jun. 14, 1983

[51] Int. Cl.[3] ..... C10L 1/30

[52] U.S. Cl. ..... 44/57; 44/68

[58] Field of Search ..... 44/57, 68

[56] References Cited

U.S. PATENT DOCUMENTS

| | | | |
|---|---|---|---|
| 2,150,349 | 3/1939 | van Peski et al. | 44/68 U X |
| 2,460,700 | 2/1949 | Lyons | 44/68 |
| 2,560,542 | 7/1951 | Bartleson et al. | 44/68 |
| 2,890,108 | 6/1959 | Toulmin, Jr. | 44/68 |
| 3,348,932 | 10/1967 | Kukin | 44/68 |

FOREIGN PATENT DOCUMENTS

| | | | |
|---|---|---|---|
| 561328 | 5/1944 | United Kingdom | 44/68 |

*Primary Examiner*—Mrs. Y. Harris-Smith

*Attorney, Agent, or Firm*—Alexander J. McKillop; Michael G. Gilman; Dennis P. Santini

[57] ABSTRACT

The invention provides a method for increasing the cetane number of a low hydrogen content, highly aromatic distillate fuel by subjecting it to catalytic partial oxidation. Catalysts employed include transition metal oxides alone or in conjuction with alkali metal or alkaline earth metal compounds. Partial oxidation in accordance with the method of this invention not only results in cetane number improvement, but also allows a higher concentration of aromatic substituents in the fuel blend.

12 Claims, No Drawings

INCREASING THE CETANE NUMBER OF DIESEL FUEL BY PARTIAL OXIDATION

BACKGROUND OF THE INVENTION

1. Field of the Invention

The invention is concerned with improved diesel fuel. More particularly, it is concerned with improving the cetane number thereof by mild, catalytic partial oxidation.

2. Description of the Prior Art

The blending of alcohols, ethers, esters and the like with hydrocarbon fuels for the purpose of increasing the octane number of said fuel is well known in the art. For instance, U.S. Pat. No. 3,904,384 discloses a high octane gasoline produced by mixing suitable hydrocarbons with t-butyl isopropyl ethers; U.S. Pat. No. 3,903,251 mixes butyl alcohol and butyl acetate with hydrocarbons, and U.S. Pat. No. 3,901,664 blends t-butyl alcohol, isopropyl alcohol and methyl alcohol with hydrocarbons to produce high octane motor fuel. These fuels typically contain as much as 40% of oxygenated compounds in the blend to increase the octane number of the gasoline to a level competitive with that of gasoline containing tetraethyl lead, an octane booster in commercial fuels. However, although many oxygenated organic compounds have high octane ratings they are not useful in diesel applications since octane and cetane numbers are inversely related, i.e., a high octane fuel will exhibit poor cetane qualties. Other oxygenates such as perioxides have been used as free radical generators to improve cetane number in additive level quantities ($<\sim 1\%$). However, the use of such specifically synthesized pure compounds is often limited by such factors as cost.

Thus, U.S. Pat. No. 4,046,522 is concerned with providing a converter system for converting a low octane, normally liquid hydrocarbon fuel to one of higher octane. In general, 4,056,522 relates to a catalytic converter adapted for installation in the fuel line of an engine to replace the conventional carburetor. There are two separate reactors in the converter arranged so the fuel passes through one and then the other so as to decompose oxygen-containing organic compounds to CO and hydrogen. The catalyst may be alumina, zinc chromite, copperzinc chromite, manganese chromite, supported iron and cobalt, etc.

SUMMARY OF THE INVENTION

In accordance with the invention there is provided a method for improving the cetane number of low hydrogen content, highly aromatic diesel boiling range fuel by heating same under mild oxidation conditions in the presence of (1) an alkaline earth metal permanganate, (2) an oxide of a metal from Groups IB, IIB, IIIB, IVB, VB, VIB, VIIB and VIII of the Periodic Table or (3) a mixture of an alkali metal oxide or salt or alkaline earth metal oxide or salt, the anion of which can be organic or inorganic, i.e., it may be, for example, an acetate ion or it may, for example, be a nitrate, sulfate, phosphate or halogen ion, and an oxide of (2). These include zinc, for example, as well as the transition metals, among them being iron, copper, vanadium, nickel, cobalt, chromium and magnesium. In general, the transition metals are defined as comprising elements 21 through 29, 39 through 47, 57 through 79 and from 89 on.

DESCRIPTION OF SPECIFIC EMBODIMENTS

In the instant invention, a large percentage of low hydrogen content highly aromatic distillate boiling range constituents are converted to a variety of oxygenates such as ketones, aldehydes, perioxides or other oxygen containing compounds by catalytic partial oxidation. Compared to the feed which is not normally suitable for use in diesel engines, the product exhibits improved ignition characteristics.

The partial oxidation may be carried out at a central location or in an on-board operation via a pre-engine converter. For example, a small reactor can be installed in the fuel line. It can, when used this way, be employed in conjunction with the carburetor, or in place of it. There may, of course, be more than one reactor, each having a single catalyst or a mixture of catalysts chosen from among those already mentioned. The use of a pre-engine or central converter has been considered with respect to octane improvement.

The raw fuel used in this invention can be any low hydrogen content, highly aromatic petroleum cut having a boiling range between about 350° F. and about 850° F., and more typically between about 400° F. and about 700° F. It will be understood that "low hydrogen content" refers to hydrogen contents of less than 12% by weight thereof and that "highly aromatic" means having an aromatic content greater than 40% by weight thereof. Cetane values from such oils may range from about 15 to about 30. One example of such a preferred feed is a FCC Light Cycle Oil having the following properties.

TABLE 1

| PROPERTIES OF FCC LIGHT CYCLE OIL | |
|---|---|
| Boiling Point Distribution, % | |
| 420° F | 4.8 |
| 420–650° F. | 87.9 |
| 650–850° F. | 7.3 |
| 850–1000° F. | — |
| 1000° F.+ | — |
| H. wt % | 10.64 |
| S. wt % | 1.01 |
| N. wt % | 0.24 |
| Ni + V, ppm | ND |
| Paraffins, wt % | 12.7 |
| Mononaphthenes | 11.7 |
| Monoaromatics | 24.7 |
| - Alkylbenzenes | (8.5) |
| - Naphthene Benzenes | (10.3) |
| - Dinaphthene Benzenes | (5.9) |
| Naphthalenes | 21.7 |
| Polyaromatics | 14.3 |
| - Acenaphthenes, Biphenyls | (6.7) |
| - Fluorenes | (3.9) |
| - Phenanthrenes | (3.1) |
| - Others | (0.6) |
| Aromatic Sulfur | 2.1 |
| % Aromatics (NET) | 62.8 |
| Heat of Combustion (BTU/lb) | 18,283 |
| Cetane Number | 20 |

The method can be used to produce the disclosed advantages over a broad range of temperatures, pressures and flow rates of feed over the catalyst. The temperature of operation may range from about 50° C. to about 350° C., preferably from about 75° C. to about 200° C. The pressure in the reaction system can be from about 0.5 to about 50 atmospheres, preferably from about 1 to 20 atmospheres. It is contemplated that the catalyst system will yield the desired results at feed flow rates of from about 0.5 to about 50 LHSV, preferably from about 3 to about 35 LHSV.

When the mixed catalyst is used, the concentration of the alkali metal oxide or salt or the alkaline earth metal oxide or salt therein will range from about 1.0% by weight to about 50% by weight.

Having described the invention in broad terms, the following Examples are offered as specific illustrations. It will be understood that the following examples are illustrative only.

EXAMPLE 1

To assess the ignition behavior of charge and product oils, a heated stainless steel block with a 48 cc ignition cavity was used to determine ignition delay times and spontaneous ignition temperatures. Fifteen ml of napthaldehyde fuel was injected rapidly into the heated ignition cavity of a reactor filled with a static atmosphere of oxygen at ambient pressure. The resulting equivalence ratio [fuel/oxygen÷stoichiometric fuel-/oxygen] was about 1.0. The cavity and stainless steel block temperatures, as well as the pressures inside the cavity, were monitored by a mini-computer. The temperature maintained was selected to give a 20 second ignition delay.

Upon fuel injection a brief drop in cavity temperature was observed due to fuel evaporation. Upon ignition a rapid temperature rise occurred. The time difference between these two temperature spikes defines the ignition delay of the fuel at the temperature of the cavity. Correlation of a parameter, such as the temperature required for a 20 second ignition delay, against measured engine cetane number for variety of fuels permits the use of ignition delay values to estimate cetane number improvement.

Using the above method and model compounds to illustrate the result of partial oxidation it was observed that naphthaldehyde exhibits a 12–15 number increase in cetane number vs. methylnaphthalene, from which it would be derived via partial oxidation.

EXAMPLE 2

Torrance light cycle oil (TLCO), defined in Table 1, was used as the base fuel. The catalysts employed were $KMnO_4$, prepared by grinding the crystals to a fine powder, and a mixture of $V_2O_5$ and $KNO_3$, prepared by grinding together the two materials in a 1:1 ratio.

About 47 gms of TLCO were charged to a round bottom flask along with 0.08–0.10 gms of powdered catalyst (0.15–0.2 wt% based on oil). The vessel was maintained at about 150° C. and 40% oxygen was bubbled continuously through the liquid at 160 ml/min., gases exiting through room temperature and dry ice traps. Liquid accumulation in these traps was negligible. Samples of the pot liquid were periodically withdrawn and filtered to remove any catalyst fines and heats of combustion and oxygen contents of these samples were determined. Cetane numbers were estimated from ignition temperature/ignition delay measurements as outlined above in Example 1. Total liquid recovery was greater than 95% of the original charge.

Table 2 summarizes the data obtained. The higher activity of the $V_2O_5$-$KNO_3$ catalyst is evident, since a cetane number enhancement of about 15 numbers was obtained after 10 hours using the catalyst, whereas with $KMnO_4$ the increase was about 10 in 65 hours.

TABLE 2

| Catalyst | Time of Reaction, Hours | Improvement in Cetane No. |
|---|---|---|
| $V_2O_5 + KNO_3$ | 0 | 0 |
| | 3 | 8.5 |
| | 19 | 15.0 |
| $KMnO_4$ | 0 | 0 |
| | 3 | 2.5 |
| | 65 | 8.0 |

From the Examples described, it is evident that partial oxidation was obtained with either catalyst and that the resulting liquids exhibited a significant enhancement in cetane rating, the enhancement increasing with increasing incorporation of oxygen into the fuel. We also observed the fact that all products retained at least 96% of their original heat content.

We claim:

1. A method for improving the cetane number of a low hydrogen content, highly aromatic diesel boiling range fuel by heating same under mild oxidation conditions in the presence of a catalyst system comprising (1) an alkaline earth metal permanganate, (2) an oxide of a metal group Groups IB, IIB, IIIB, IVB, VB, VIB, VIIB or VIII of the Periodic Table, or (3) a mixture of (2) and an alkali metal or alkaline earth metal oxide or salt.

2. The method of claim 1 wherein said catalyst is an alkaline earth metal permanganate.

3. The method of claim 2 wherein the alkaline earth metal is potassium.

4. The method of claim 1 wherein said catalyst is the catalyst of (2).

5. The method of claim 4 wherein the catalyst of (2) is $V_2O_5$.

6. The method of claim 1 wherein said catalyst is the catalyst of (3).

7. The method of claim 6 wherein the catalyst of (3) is a mixture of $V_2O_5$ and $KNO_3$.

8. The method of claim 1 wherein the alkali metal or alkaline earth metal oxide or salt is present in the mixture with the oxides of (2) to the extent of from about 1% by weight to about 50% by weight of the mixture.

9. The method of claim 1 wherein the temperature of oxidation is from about 50° C. to about 350° C.

10. The method of claim 1 wherein the pressure during reaction is from about 0.5 to about 50 atmospheres.

11. The method of claim 1 wherein the flow rate of feed over the catalyst is from about 0.5 to about 50 LHSV.

12. The method of claim 7 wherein the $V_2O_5$ and $KNO_3$ are present in equal weights.

* * * * *